US006836696B2

(12) United States Patent
Van Hullen

(10) Patent No.: US 6,836,696 B2
(45) Date of Patent: Dec. 28, 2004

(54) METHOD FOR MARKING ROLLED MATERIAL

(75) Inventor: Peter Van Hullen, Ibbenburen (DE)

(73) Assignee: Georgsmarienhütte GmbH, Georgsmarienhütte (DE)

( * ) Notice: Subject to any disclaimer, the term of this patent is extended or adjusted under 35 U.S.C. 154(b) by 346 days.

(21) Appl. No.: 10/069,496

(22) PCT Filed: Jun. 7, 2001

(86) PCT No.: PCT/DE01/02128

§ 371 (c)(1),
(2), (4) Date: Feb. 14, 2002

(87) PCT Pub. No.: WO01/96040

PCT Pub. Date: Dec. 20, 2001

(65) Prior Publication Data

US 2002/0123822 A1 Sep. 5, 2002

(30) Foreign Application Priority Data

Jun. 16, 2000 (DE) ..... 100 29 725

(51) Int. Cl.[7] ..... G06F 19/00
(52) U.S. Cl. ..... 700/148; 700/110; 702/183
(58) Field of Search ..... 700/108–110, 117, 700/122, 148, 150; 702/183–185

(56) References Cited

U.S. PATENT DOCUMENTS 3,673,493 A * 6/1972 Hoffman et al. ..... 324/226
4,304,981 A 12/1981 Gappa
4,958,307 A * 9/1990 Nishimura ..... 382/141
5,379,237 A * 1/1995 Morgan et al. ..... 703/2
5,654,977 A * 8/1997 Morris ..... 374/4
5,798,925 A * 8/1998 Poling ..... 700/123
5,808,202 A * 9/1998 Passarelli, Jr. ..... 73/643
6,266,983 B1 * 7/2001 Takada et al. ..... 72/11.1

FOREIGN PATENT DOCUMENTS

| | | |
|---|---|---|
| DE | 23 51 525 | 4/1975 |
| DE | 40 20 839 | 4/1991 |
| DE | 42 17 007 | 11/1993 |
| DE | 196 09 563 | 9/1997 |

* cited by examiner

*Primary Examiner*—Leo Picard
*Assistant Examiner*—Zoila Cabrera
(74) *Attorney, Agent, or Firm*—Collard & Roe, P.C.

(57) ABSTRACT

The invention relates to a method for marking material defects in/on bar-shaped rolled material after it has left the finishing rolling mill. According to this method, the defective points are detected during the rolling process by ultrasound testing and/or inductive testing and this information is supplied to a computer, which identifies and stores the defective points according to their type and position in the rolled product. The computer then uses this data to control a marking device in such a way that the bar-shaped finished material is marked according to the defect type, respectively, at the point determined by the computer.

6 Claims, No Drawings

METHOD FOR MARKING ROLLED MATERIAL

CROSS REFERENCE TO RELATED APPLICATIONS

Applicant claims priority under 35 U.S.C. §119 of German Application No. 100 29 725.0, filed on Jun. 16, 2000. Applicant also claims priority under 35 U.S.C. §120 of PCT/DE01/02128, filed on Jun. 7, 2001. The international application under PCT article 21(2) was not published in English.

The invention relates to a method for marking defects detected in/on rod-shaped rolled material.

As a rule, steel products that have already been rolled to the finished quality are checked for internal and external defects with the help of suitable test devices.

For the detection of internal defects, ultrasound test heads are employed, among other devices, and for the detection of surface defects, for example production line coils or eddy-current probes rotating around the rolled material are used.

The determined defects are marked on the product, for example on a round rod, either over the entire circumference or only locally depending on the type of flaw detected. Surface defects do not always lead to sorting out of the rods because it may be possible to repair the flawed rods. Internal defects cannot be repaired. The defective piece has to be cut out.

As a rule, internal defects are caused already in the course of the casting process, or originate in the cooled-down steel block from which the rods are to be rolled.

The greater the length to which such a steel block is rolled out, in the end effect up to the rod-shaped final product, the more difficult it is to detect the internal defects. It therefore happens that defects present in the starting product can no longer be detected in the finished product.

Therefore, in connection with the method described, the testing for defects and the marking of the defects start only after the material processed for an order has been rolled out. This means that each rod has to be checked (after the rod material has been cut to the length specified by the customer, as a rule) in a separate work operation.

The invention is based on the problem of controlling a method of the type specified above in such a way that the defects are detected as early as possible already in the course of the rolling process, and that the defects can be marked both on the hot and the cooled material already prior to the subsequent steps of the process such as, for example the straightening of the rods, so that the time elapsing between the rolling process, the testing step and the step in which the defective rods are sorted out, is minimized. Any reshaping steps or cooling lines that may be interconnected between the internal test and the external test are taken into account in this connection accordingly.

Said problem is solved by the invention with the help of a method in such a way that the defective spots are detected by means of ultrasound testing and/or inductive testing in the course of the rolling process; that said information is supplied to a computer and identified and stored by such computer according to the type and location of the defect in the rolled products; and that the computer then controls a marking device with the help of such data in such a manner that the rod-shaped finished material is marked in the location determined by the computer according to the respective type of defect involved.

Therefore, an important aspect in connection with the present invention is that the defects can be detected also already prior to the finishing rolling step, thus in a site where the starting product has not as yet been rolled out to such an extent that the defects present could be "overlooked", while the detected defects, however, are marked on the finished product nonetheless according to their type and location directly after the rolling operation, or after the rolled product has been cut to the length of the cooling bed or to the length specified by the customer, so that the flawed products can be sorted out with the help of said marking according to "good", "repairable" or "rejected" material depending on the type of defect involved.

This is accomplished by means of an electronic data processing system which, after a defect has been reported, recognizes the type of defect involved, calculates the location of the defect in the later final product, and controls the marking device with the help of said data. The term "marking" means in the present context primarily a color marking on the final product. The product can be marked with different colors for internal and external defects, and repairable and irrepairable defects.

However, according to the invention, "marking" also relates to an electronic virtual marking with the help of which the sorting process is controlled, whereby the computer is coupled with the sorting device.

Owing to the fact that the detection and marking of defects are integrated in the rolling and cutting-to-length process, the result is a more precise and primarily a sure-targeted detection of defects, and a minimization of the processing time. Thus the rods detected to be good can be directly transported to the straightening or fin removal stations.

Since it is known from past experience that many defects are found in the head piece of the rolled material, the detection of defects according to claim 9 is started only with a time delay, notably depending on the final rolling speed (3 m/s to 15 m/s), so that the head piece, which has to be cropped in any case, is disregarded in the detection as well as marking steps.

According to claim 9, provision is made that the detected individual defects are summed up during a preset period of time and the marking command is triggered only once a previously defined defect relevance level has been reached.

In this way, it is assured that not every minor defect will immediately lead to a marking command, but that only defects are marked that make the product in fact unusable or lead to reworking of the material.

According to claim 10, the detected relevant defects are marked directly on the hot rolled material shortly after the latter has exited from the last rolling stand, thus before the material is cut to the length of the cooling bed.

With the help of the installed electronic data processing system it is possible also to mark the material after it has been cooled on the cooling bed, before or after it is cut to the length specified by the customer. For this purpose, the material has to be logically marked by the program stored in the computer, so that the flawed part of the rolled rod can be virtually marked and sorted out.

It may be fixed in the program of the computer how the cooling bed lengths are optimally used for the division to customer-specified lengths.

In the customer-specified lengths (for example 6 m) there are always certain tolerances possible or determined.

If, for example, an unflawed piece with a length of 35 m is present in a cooling length, it is not necessarily required to cut five 6-m customer lengths, so that an unusable piece of 5 meters length remains. The tolerances are used in such a way that in the present case, for example, the 35 meters are divided in six lengths of 5.83 m length each.

Said method as defined by the invention, possibly in conjunction with an automatic sorting device, leads to a high effect rationalization as far as the costs are concerned, on the one hand, and the expenditure of time on the other.

What is claimed is:

1. A method for marking material defects in and on rod-shaped rolled material upon exiting of the rolled material from the finishing rolling stand, in which the defects are detected in the course of the rolling process internally by means of ultrasound testing and externally by means of inductive testing, said information is supplied to a computer, the defects are identified and stored by the computer according to the type of defect and the location, and the computer controls a marking device with the help of said data in such a way that the rod-shaped, finished material is marked in the site determined by the computer according to the respective type of defect, wherein deformation steps located between the internal test and the external test are taken into consideration and defect detection and the marking command take place only after a pre-set time period dependent on rolling speed has elapsed from the start of the material test.

2. The method according to claim 1, wherein the detected individual defects are summed up in the course of a preset period of time and the marking command is triggered only after a defined defect relevance level has been reached.

3. The method according to claim 1, wherein the marking takes place directly on the hot rolled material prior to the cutting to cooling bed lengths.

4. The method according to claim 1, wherein the marking takes place after the cutting to cooling bed lengths prior to or after the cutting to the length specified by the customer.

5. The method according to claim 1, wherein the marking is only a virtual marking carried out and stored by the computer program.

6. The method according to claim 1, wherein an automatic sorting out is carried out based on the marking by means of electronic or optical detection of the marking.

* * * * *